US005388349A

United States Patent [19]

Ogden

[11] Patent Number: 5,388,349

[45] Date of Patent: Feb. 14, 1995

[54] FOOTWEAR INSOLE

[75] Inventor: John M. Ogden, Cincinnati, Ohio

[73] Assignee: Ogden, Inc., Cincinnati, Ohio

[21] Appl. No.: 828,426

[22] Filed: Jan. 31, 1992

[51] Int. Cl.[6] ..... A43B 13/38; B32B 3/10

[52] U.S. Cl. ..... 36/43; 36/44

[58] Field of Search ..... 36/19.5, 43, 44, 114

[56] References Cited

U.S. PATENT DOCUMENTS

| | | | |
|---|---|---|---|
| 3,735,511 | 5/1973 | Gilbert et al. | 36/44 |
| 3,853,665 | 12/1974 | Gardziella | 36/19.5 |
| 4,043,058 | 8/1977 | Hollister et al. | 36/28 |
| 4,186,499 | 2/1980 | Massock, Jr. et al. | 36/44 |
| 4,223,458 | 9/1980 | Kihara | 36/44 |
| 4,524,529 | 6/1985 | Schaefer | 36/44 |
| 4,533,351 | 8/1985 | Washkuhn | 36/140 |
| 4,539,783 | 11/1985 | Andrews | 36/98 |
| 4,569,707 | 2/1986 | Johnson | 36/98 |
| 4,602,442 | 7/1986 | Revill et al. | 36/43 |
| 4,729,179 | 3/1988 | Quist, Jr. | 36/44 |
| 4,845,862 | 7/1989 | Phillips, Jr. et al. | 36/83 |
| 4,864,740 | 9/1989 | Oakley | 36/44 |
| 4,893,418 | 1/1990 | Ogden | 36/44 |
| 4,925,724 | 5/1990 | Ogden | 12/146 B |
| 5,036,603 | 8/1991 | Dischler | 36/44 |

*Primary Examiner*—Paul T. Sewell
*Assistant Examiner*—M. D. Patterson

[57] ABSTRACT

An insole for articles of footwear comprises an apertured top layer formed from a non-absorbent, thermally non-conductive thermoplastic material which is affixed to a stabilizing layer formed of a non-woven material. The stabilizing layer, in turn, is affixed to a barrier layer and/or a cushioning layer to form insoles for articles of footwear intended for different activities.

18 Claims, 2 Drawing Sheets

FOOTWEAR INSOLE

RELATED PATENTS

This invention is related to the subject matter disclosed in U.S. Pat. No. 4,893,418 and U.S. patent application Ser. No. 07/828,690, entitled "Slip-Resistant, Sheet Material", filed concurrently herewith, both of which are owned by the assignee of this invention, and the disclosures of which are incorporated by reference in their entireties herein.

FIELD OF THE INVENTION

This invention relates generally to insoles for articles of footwear, and, more particularly, to an insole comprising a laminate of a non-absorbent, thermally non-conductive top layer formed with apertures and a stabilizing layer, which can be affixed to at least one other layer such as a barrier layer and/or a cushioning layer.

BACKGROUND OF THE INVENTION

New designs of footwear, and particularly footwear intended for sports or other active wear, have provided improvements in the support, cushioning and stability in an effort to reduce injuries to the feet, ankles and knees. One aspect of active wear footwear design which has been overlooked, however, is the configuration and surface characteristics of the insole or sockliner of the article of footwear as they relate to the ability of the insole to maintain the foot and sock insulated from the sole of the footwear, and the extent which the foot and sock are permitted to move within the article of footwear.

One problem with many insoles for active wear footwear involves a failure to control the motion of the sock of the wearer relative to the insole and/or the motion of the foot of the wearer with respect to the sock. This affects both the comfort and performance of the shoe. For example, certain activities such as the play of tennis on clay courts and soccer on grass result in substantial movement of the shoe with respect to the playing surface. In these types of activities, it is desirable to limit the movement of the foot and sock with respect to the insole of the article of footwear for added comfort and to optimize the performance of the footwear. On the other hand, comfort and performance of the article of footwear dictate that the foot and sock be permitted more movement within footwear intended for use in activities such as basketball, racquetball and aerobics which are typically played on a lacquered hardwood floor wherein limited movement of the article of footwear relative to the playing surface is permitted and therefore relatively high shear forces are transmitted from the footwear to the foot.

Prior art insoles can generally be divided into two categories, both of which fail to take into account the movement of the foot and/or sock within the article of footwear and the type of surface on which the footwear is utilized. In some designs, the top surface of the insole is formed of a tacky or sticky material, or a material which becomes relatively tacky when exposed to moisture from the foot. Insoles of this type exhibit a higher coefficient of friction than the coefficient of friction of the skin of the foot. As a result, the magnitude of the frictional engagement between the sock and insole is greater than the magnitude of the frictional engagement between the foot and sock. Articles of footwear provided with this type of insole have been found to create blisters on the foot during use because the foot is allowed to move within the sock in response to the application of a shear force, i.e., a front-to-rear and/or a side-to-side foot motion, while the sock is held in an essentially fixed position atop the insole. The rubbing motion of the foot within the sock can create severe blistering and discomfort, particularly in activities such as basketball and the like played on hardwood floors which permit limited motion of the shoe therealong.

Another general category of insole designs comprises a rubber or foam bottom layer which is covered by an overlayer of cloth or leather having a relatively slippery or slick surface with a much lower coefficient of friction compared to that of the skin. Insoles of this type help avoid the blistering problem because the foot and sock can move as a unit relative to the slippery top layer of the insole, instead of the foot moving within the sock. But the problem with these insoles is that movement of the sock and foot of the wearer is often completely unrestricted, and the toes are permitted to violently slide into the toe portion of the article of footwear causing bruising or even fractures. In addition, undue movement of the foot and sock gives the wearer a feeling of lack of control of the footwear, particularly in activities where the footwear readily slides along the playing surface.

These problems have been addressed in U.S. Pat. No. 4,893,418, owned by the assignee of this invention. The insole disclosed in such patent comprises a bottom layer formed of a cushioning material such as rubber or foamed plastic having an upper surface, and a lower surface adapted to overlie the sole of an article of footwear such as a shoe. The insole also includes a top layer formed of a non-absorbent, thermally non-conductive thermoplastic material having a plurality of apertures which define intersecting columns and rows of thermoplastic strands or wall sections. The top layer is at least partially embedded in the bottom, cushioning layer so that a portion of the top layer extends beneath the upper surface of the bottom layer and the cushioning material forming the bottom layer at least partially enters the apertures in the top layer.

One advantage of the insole of U.S. Pat. No. 4,893,418 is that the frictional characteristics of the upper surface of the top layer are variable to control the movement of the foot and sock with respect to the insole, depending upon the type of activity and playing surface for which a particular article of footwear is designed. For example, in order to reduce or prevent blistering of the foot, the coefficient of friction of the apertured top layer is chosen such that the magnitude of the frictional engagement between the sock and such top layer is greater than the magnitude of the frictional engagement between the foot and sock during a given activity. As a result, the foot and sock move together as a unit with respect to the top layer of the insole in response to the application of a shear force to the foot instead of the foot sliding within the sock. Because the foot does not move with respect to the sock, the foot is substantially protected from the development of blisters and other problems created by sliding motion within an article of footwear.

While the sockliner or insole disclosed in U.S. Pat. No. 4,893,418 provides a number of advantages over other insoles, it has been found that some potential problems can arise with the use of such insole in articles of footwear, particularly those intended for certain types of vigorous activities such as basketball, racquetball, etc. As mentioned above, the apertures in the top layer of the insole form a matrix of interconnected wall sections, such as squares, triangles or the like. These wall sections are on the order of about 0.6 millimeters in thickness and about 0.5 millimeters in width. The thermoplastic material utilized to form this relatively thin apertured top layer exhibits good strength in compression, but is comparatively weak in shear. As a result, front-to-back and/or side-to-side motion of the sock along the apertured top layer has a tendency to stretch, pull or otherwise move the wall sections of the top layer relative to one another. The resilient cushioning material within which the apertured top layer is embedded offers substantially no resistance to the application of such shear forces and thus readily permits such relative motion of the wall sections. The apertured top layer is therefore subject to tearing or ripping of its wall sections, and the cushioning material beneath can become worn and break down as the apertured top layer moves therealong.

Another potential problem in the use of the insole disclosed in U.S. Pat. No. 4,893,418 in certain types of applications is that the apertured top layer can become delaminated from the cushioning layer. As disclosed in such patent, the apertured top layer and cushioning layer are interconnected by introducing the top layer onto the cushioning layer when it is in a "foamed" state, i.e., wherein the material has the consistency of whipped cream or the like before it is cured to a solid sheet. Alternatively, the apertured top layer can be molded to cushioning materials such as polyurethane which is liquid when initially combined with the top layer and thereafter cures to form a solid layer. In either case, the only connection between the apertured top layer and cushioning layer is the extent of surface contact between the cushioning material and the bottom and sides of the wall sections of the apertured top layer. This is a relatively small surface area. Additionally, the wall sections are made relatively smooth to provide comfort when contacted by the foot or sock of the wearer, which further increases the difficulty of obtaining a secure bond between the top layer and cushioning layer sufficient to avoid delamination.

SUMMARY OF THE INVENTION

It is therefore among the objectives of this invention to provide an insole for active wear footwear which provides a thermal barrier between the foot and sole of the footwear, which controls the movement of the foot and sock within the interior of the article of footwear and which is resistant to wear, particularly under the application of shear forces.

These objectives are accomplished in an insole comprising an apertured top layer formed from a non-absorbent, thermally non-conductive thermoplastic material which is affixed to a stabilizing layer formed of a non-woven material. In alternative embodiments, the stabilizing layer, in turn, is affixed to a barrier layer and/or a cushioning layer to form insoles for different types of articles of footwear intended for different activities.

One aspect of this invention is predicated upon the concept of controlling the motion of the foot and sock within the interior of an article of footwear with an insole which is highly resistant to wear and delamination. The non-absorbent, thermally non-conductive thermoplastic material which forms the top layer of the insole herein includes a plurality of spaced apertures defining strands or wall sections in the top layer between the apertures. These wall sections, preferably in the shape of interconnected squares, triangles or the like, are relatively small, i.e., on the order of about 0.6 millimeters in height and 0.5 millimeters in width. While such wall sections are strong in compression, the application of a shear force to the top layer induces the wall sections to stretch and move relative to one another which can cause tearing in the absence of constraint. The non-woven material affixed to the apertured top layer is characterized as a "stabilizing layer" because it provides for dimensional stability of the apertured top layer to resist movement under the application of shear forces. The apertured top layer is preferably glued or otherwise permanently affixed to the stabilizing, non-woven layer such that the wall sections of the apertured top layer are substantially constrained from movement relative to one another under the application of a shear force. This greatly enhances the dimensional integrity and durability of the apertured top layer, particularly when the insole is incorporated in articles of footwear intended for active sports wherein the front-to-back and side-to-side motion of the foot can be severe.

In addition to the dimensional stability and durability provided by affixing the non-woven, stabilizing layer to the apertured top layer, the stabilizing layer also contributes to the structural integrity of multi-layer insoles made in accordance with the teachings of this invention. In alternative embodiments herein, the surface of the stabilizing layer opposite the apertured top layer is affixed to a cushioning layer such as crosslinked polyethylene, latex foam, polyurethane foam or other cushioning materials. In the presently preferred embodiment, the non-woven material forming the stabilizing layer is comprised of pressed fibers of 100% polyester, a blend of rayon and polyester, or a blend of cellulosic material such as wood pulp and polyester. It has been found that the non-woven fibrous constituents of the non-woven material create an extremely effective bond with cushioning material of the type mentioned above. It is believed that the fibers of the non-woven material at least partially entangle or intertwine with the cushioning material thus providing a comparatively large surface area of contact therebetween so that an extremely secure bond is formed between the non-woven material and the cushioning layer. As a result, an insole formed by the laminate of an apertured top layer, a non-woven stabilizing layer and a cushioning layer is securely held together and there is little chance of delamination of any one of the three layers from the others.

In another aspect of this invention, it is recognized that different types of materials are preferable to others in forming the cushioning layer of the insole herein depending upon the particular type of activity for which an article of footwear is intended and the preferences of the wearer. One type of material commonly in use in the formation of insoles is polyurethane. In the formation of contoured insoles for athletic shoes, for example, polyurethane in liquid form is introduced into either an "open" mold, which is analogous to a waffle iron, or a closed mold which is analogous to an injection mold. In order to affix the laminate of the apertured top layer and non-woven stabilizing layer to the polyurethane, such laminate must be introduced into the mold with the liquid polyurethane. It has been found that in the course of closing the mold halves of the open mold, or in introducing the liquid polyurethane into the closed mold, sufficient pressure is developed to force the liquid polyurethane through the non-woven layer and through the apertures in the apertured top layer. This produces a "bleed-through" problem wherein at least a portion of the polyurethane is located atop the apertured top layer in the form of beads after the polyurethane has cured.

In order to avoid this bleed-through problem, a further embodiment of this invention has been provided. In this embodiment, a "barrier layer" is affixed to the surface of the non-woven layer opposite the apertured top layer. This barrier layer is preferably a thin layer of acrylic latex, polyethylene, ethylene-vinyl acetate copolymer, vinyl or similar materials which are substantially liquid impervious. The barrier layer is effective to block the flow of the liquid polyurethane during a molding operation using either type of molding apparatus mentioned above, so that there is no bleed-through of the polyurethane into the non-woven layer or into the apertured top layer in the finished insole. It is presently contemplated that such barrier layer may not be necessary in the formation of insoles according to this invention wherein a latex foam or crosslinked polyethylene foam is applied to the non-woven layer since these materials have a more solid consistency when combined with the apertured top layer and stabilizing layer, e.g., like whipping cream, and do not tend to bleed-through such layers prior to curing.

In any of the embodiments of the insole herein mentioned above, an important aspect of this invention is predicated upon the frictional characteristics of the apertured top layer of the insole. In the presently preferred embodiment, the apertured top layer is formed of an ethylene-vinyl acetate copolymer whose vinyl acetate content can be varied to vary the coefficient of friction of the material. Tests have shown that regardless of the vinyl acetate content and resulting coefficient of friction, the apertured top layer of this invention exhibits the same coefficient of friction wet or dry. This feature of the apertured top layer of the insoles herein provide substantial benefits in functionality which cannot be achieved with prior art insoles.

One advantage of the construction of the apertured top layer involves protection of the foot from blistering and other discomfort caused by movement of the foot with respect to the sock. The coefficient of friction of the apertured top layer herein is maintained such that the magnitude of the frictional engagement between the apertured top layer and sock is less than the magnitude of frictional engagement between the sock and foot. This is true whether or not the apertured top layer is wet or dry. The objective is to prevent movement of the foot with respect to the sock as the foot sweats and moistens the sock. By ensuring that the magnitude of the frictional engagement between the apertured top layer and sock is less than that between the sock and foot, the sock and foot are made to move as a unit along the insole while the foot is held substantially fixed with respect to the sock. Because the foot is thus prevented from sliding within the sock, the rubbing movement which can cause blisters is eliminated.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
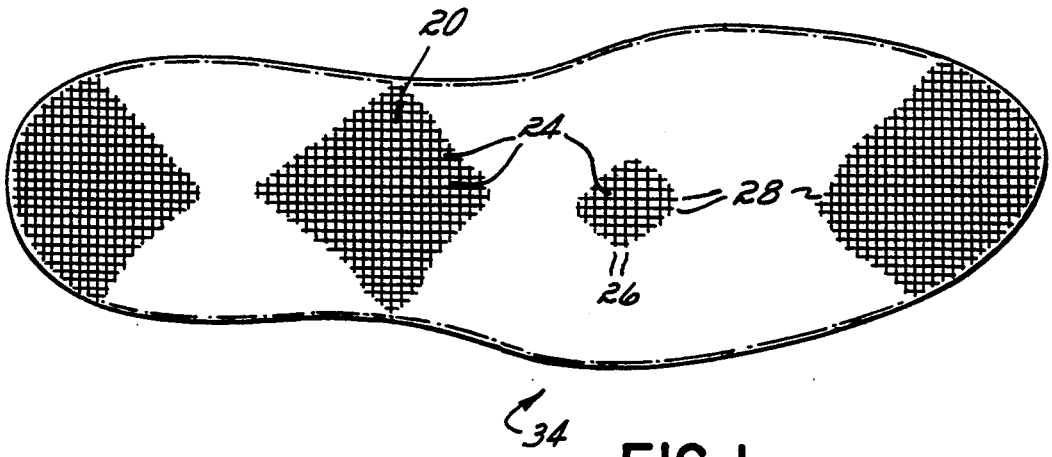
FIG. 1 is a plan view of one embodiment of the insole of this invention.
Figure 2:
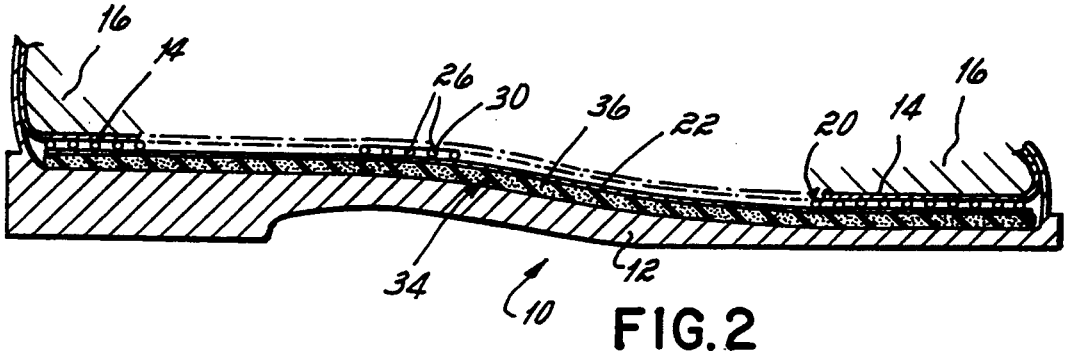
FIG. 2 is a partial cross sectional view of a shoe incorporating one embodiment of the insole of this invention.

Referring now to FIGS. 1 and 2, a schematic view of an article of footwear such as a shoe 10 is illustrated having a sole 12 and an insole 34, described in detail below, which is positioned atop the sole 12. The insole 34 supports the sock 14 and foot 16 of the wearer. This invention is directed to various constructions of insoles for use in articles of footwear such as the shoe 10 which provides comfort and control of the shoe 10, and which protects the foot 16 from blistering and from violent collisions with the toe portion and uppers (not shown) of the shoe 10 which can damage the toes and other portions of the foot.

Figure 4:
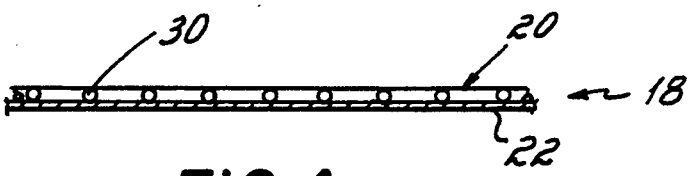
FIG. 4 is a cross sectional view of a portion of one embodiment of the insole herein.

With reference to FIG. 4, one embodiment of an insole 18 is illustrated which comprises an apertured top layer 20 affixed to a stabilizing layer 22. In the presently preferred embodiment, the apertured top layer 20 is formed of a non-absorbent, thermally non-conductive thermoplastic material such as an ethylene-vinyl acetate copolymer commercially available from U.S. Industrial Chemicals Company of Tuscola, Ill. under the registered trademark "ULTRATHENE". As discussed in more detail below, the vinyl acetate content of the ULTRATHENE thermoplastic material is variable to alter the coefficient of friction of the apertured top layer 20 as desired.

The ethylene-vinyl acetate copolymer is extruded in sheet form, in a configuration described below, which is then cut to form the top layer 20 of insole 18. In the presently preferred embodiment, a quantity of thermoplastic elastomer is added to the ethylene-vinyl acetate copolymer in an effective amount to prevent wrinkling of the sheet material after it is extruded. The thermoplastic elastomer content of the top layer 20 is preferably in the range of about 20% to 40% by weight, and more preferably about 25% by weight. One suitable type of thermoplastic elastomer is commercially available under the trade name KRATON D 3226 from Shell Oil Company of Oak Brook, Ill.

Figure 3:
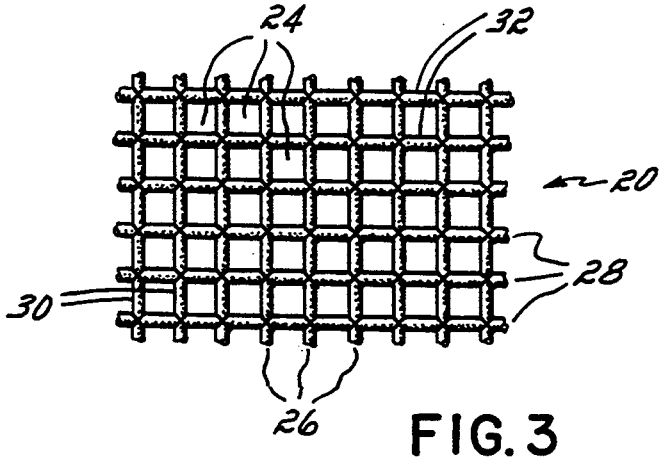
FIG. 3 is an enlarged plan view of the apertured top layer of the insole shown in FIGS. 1 and 2.

As best illustrated in FIGS. 1 and 3, the apertured top layer 20 is formed with a plurality of apertures 24 spaced at regular intervals from one another. These apertures 24 define spaced strands or wall sections 30 of thermoplastic material arranged in side-by-side columns 26, and spaced strands or wall sections 32 of thermoplastic material arranged in side-by-side rows 28.

In one presently preferred embodiment, the apertures 24 in the top layer 20 are substantially square in cross section, i.e., wherein the columns 26 and rows 28 of wall sections 30 and 32, respectively, intersect one another at right angles. It is contemplated, however, that the apertures 24 could be formed in other shapes such as triangular, octagonal, hexagonal and the like. The dimensions of the apertures 24 are not critical, although it is preferable that there be in the range of about 7 to 107 apertures 24 per square centimeter of surface area of apertured top layer 22. With square apertures 24, this produces a "strand count" in the range of about 1 to 14 strands per lineal centimeter in both directions. It has been found that within this range, a strand count of about 8 to 9 strands per centimeter is acceptable in most insoles, i.e., the apertured top layer 22 has 8 to 9 columns 26 of wall sections 30 within one centimeter along a direction from right to left as viewed in FIG. 3, and 8 to 9 rows 28 of wall sections 32 along one centimeter in a direction from top to bottom as viewed in FIG. 3. This range of strand counts is not intended to be restrictive of the configuration of top layer 20, but it has been found that such configuration produces a top layer 20 which exhibits good performance properties.

The thickness or height of the wall sections 30 and 32 forming the apertured layer 20, i.e., their largest transverse dimension measured in a vertical plane as viewed in FIGS. 4–9, is preferably in the range of about 0.38 to 3.8 millimeters. More preferably, the thickness of such wall sections 30, 32 is about 0.6 millimeters. The width of the wall sections 30 and 32 measured in a horizontal plane as viewed in FIG. 3 is in the range of about 0.38 to 3.8 millimeters and preferably about 0.5 millimeters. It is contemplated that the height or thickness dimension, and the width dimension, of the wall sections 30 and 32 could be increased as desired for a particular application. The above ranges of dimensions of the wall sections 30 and 32 are therefore not intended to be restrictive. Additionally, in the embodiment of the insole 18 illustrated in FIG. 4, and in other embodiments discussed below, the wall sections 30 and 32 forming the apertured top layer 20 have a generally circular or at least arcuate-shaped cross section. It is contemplated, however, that the cross section of the wall sections 30, 32 could be square or rectangular in shape depending upon the configuration of the extrusion equipment used to form apertured top layer 20.

In the embodiment of the insole 18 illustrated in FIG. 4, and in each of the other embodiments of this invention discussed below, the stabilizing layer 22 is formed of a non-woven material such as that commercially available under the trademark "SONTARA" from DuPont Sontara of Old Hickory, Tenn. Non-woven sheet materials are typically formed of petrochemical fibers, cellulosic fibers and/or blends of such fibers. For example, the SONTARA non-woven material is available in sheets of 100% polyester, a blend of 70% rayon and 30% polyester and a blend of 55% cellulosic fibers such as wood pulp and 45% polyester. In one presently preferred embodiment, the stabilizing layer 22 is fabricated from a non-woven sheet of SONTARA Style 8005 which is a 100% polyester non-woven material having a unit weight of 68 grams per square meter and a thickness of 0.65 millimeters. Additionally, SONTARA Style No. 8801 has been utilized which is a blend of 55% wood pulp and 45% polyester having a unit weight of 68 grams per square meter and a thickness of 0.41 millimeters.

An insole 18 fabricated with an apertured top layer 20 and stabilizing layer 22 of the materials set forth above is cut in the general shape of a footprint as depicted in FIG. 1 and adapted to overlie the sole 12 of a shoe 10 such that the stabilizing layer 22 contacts the sole 12. The purpose of the stabilizing layer 22 of non-woven material is to provide dimensional stability to the apertured top layer 20. While the apertured top layer 20 formed of an ethylene-vinyl acetate copolymer exhibits good strength in compression, its wall sections 30 and 32 tend to deform, stretch or otherwise move relative to one another under the application of shear forces to the apertured top layer 20, i.e., forces directed in a horizontal plane such as those imposed by front-to-back, side-to-side and/or twisting motion of the sock 14 and foot 16 upon the insole 18 within the shoe 10. The stabilizing layer 22 is heated laminated, glued or otherwise permanently affixed to the apertured top layer 20. The non-woven material forming the stabilizing layer 22 is comparatively strong in shear, and it is effective to stabilize the wall sections 30 and 32 of top layer 20 by substantially constraining their movement relative to one another in response to the application of shear forces to the apertured top layer 20. This substantially reduces tearing or other damage to the wall sections 30, 32 and thus increases the wear life of the apertured top layer 20.

Figure 6:
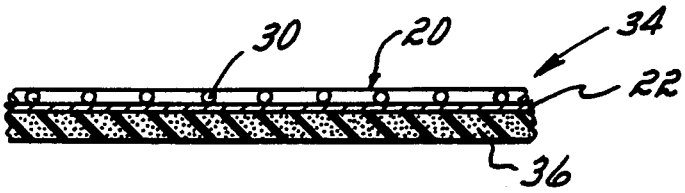
FIG. 6 is a cross sectional view of an insole herein incorporating the construction of FIG. 4 with the addition of a cushioning layer.

An alternative embodiment of an insole 34 is illustrated in FIG. 6 which incorporates the apertured top layer 20 and stabilizing layer 22 of insole 18, and further includes a cushioning layer 36. As depicted in FIG. 6, the cushioning layer 36 is affixed to the bottom of stabilizing layer 22 thus forming a trilaminate in which the stabilizing layer 22 is sandwiched between the apertured top layer 20 and the cushioning layer 36. The cushioning layer 36 is preferably formed of a resilient, cushioning material such as latex foam or other open cell foams, but cushioning materials such as polyvinyl chloride foam, urethane foam, rubber, polyurethane, crosslinked polyethylene, etc. can also be utilized. In addition to the properties exhibited by the laminate of the top layer 20 and stabilizing layer 22 discussed above, the cushioning layer 36 provides the insole 34 with a resilient, cushioning feel when contacted by the foot 16. The cushioning layer 36 may be in the form of a flat sheet which can be adhered or placed atop the sole 12 of shoe 10, or, in the case of athletic shoes, the cushioning layer 36 can be molded in a contoured shape to conform to the sole 12 and heel area of the shoe 10. See FIG. 2. The thickness of the cushioning layer 36 is variable depending upon the design of a particular article of footwear, the degree of cushioning feel desired and other factors.

Figure 5:
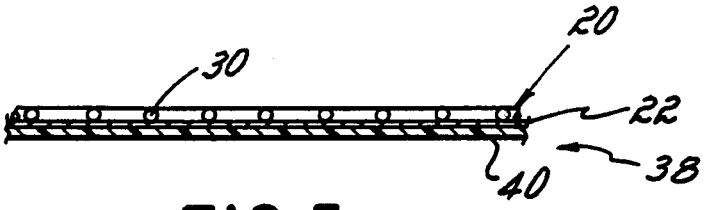
FIG. 5 is a cross sectional view of a portion of another embodiment of the insole herein.

With reference to FIG. 5, a still further embodiment of an insole 38 according to this invention is illustrated. The insole 38 comprises the same apertured top layer 20 and stabilizing layer 22 of insole 18, with the addition of a barrier layer 40 having a thickness on the order of about 0.3 millimeters. This barrier layer 40 is affixed by adhesive or any other suitable means to the bottom of the stabilizing layer 22 such that the stabilizing layer 22 is sandwiched between the apertured top layer 20 and barrier layer 40. In the presently preferred embodiment, the barrier layer 40 can be formed of a variety of substantially moisture impervious materials such as acrylic latex, polyethylene, vinyl, ethylene-vinyl acetate copolymer and the like. Additionally, the barrier layer 40 preferably includes an antimicrobial material having bacteriostatic and fungistatic properties. One suitable antimicrobial material is commercially available under the trademark ULTRAFRESH DM50, distributed by Thomson Research Associates of Toronto, Canada.

It is contemplated that the insole 38 of FIG. 5 can be effectively utilized in articles of footwear such as ladies' high heels wherein little or no cushioning is needed, but control of the movement of the foot within the shoe is desirable. The manner in which such control of foot movement is obtained is described in more detail below. Preferably, the insole 38 is cut in the shape of a footprint, as generally depicted in FIG. 1, and would be affixed such as by gluing or the like to the sole of a high heel or other shoe such that the barrier layer 40 contacts the sole.

Figure 8:
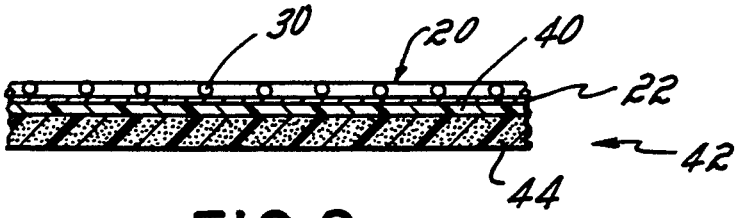
FIG. 8 is a cross sectional view of an insole according to this invention which incorporates the construction of FIG. 5 with the addition of a cushioning layer.

With reference to FIG. 8, a further embodiment of an insole 42 is illustrated which incorporates the apertured top layer 20, stabilizing layer 22 and barrier layer 40 of insole 38, with the further addition of a cushioning layer 44 preferably formed of polyurethane. This cushioning layer 44 is affixed to the bottom of the barrier layer 40 as shown. The insole 42 can take the same shape as insole 36, i.e., it can be cut in a flat sheet and placed atop the sole 12 of shoe 10 or molded in a desired contoured shape.

The polyurethane forming cushioning layer 44 is introduced in liquid form into an open mold or closed mold (not shown) where it is combined with the remaining layers of insole 42. This insole molding operation is practiced commercially and forms no part of this invention. Because the non-woven material forming the stabilizing layer 22 is porous, and the top layer 20 is formed with apertures 24, the presence of the moisture impervious barrier layer 40 is necessary to prevent bleed-through or passage of the liquid polyurethane forming the cushioning layer 44 into the stabilizing layer 22 and/or apertured top layer 20 during the molding operation. If the polyurethane was permitted to pass through the apertured top layer 20, and thereafter cure, beads or dots of polyurethane would form atop the finished insole 42. The principal purpose of the barrier layer 40 is therefore to prevent such bleed-through and allow the formation of an insole 42 with an acceptably smooth apertured top layer 20.

Figure 7:
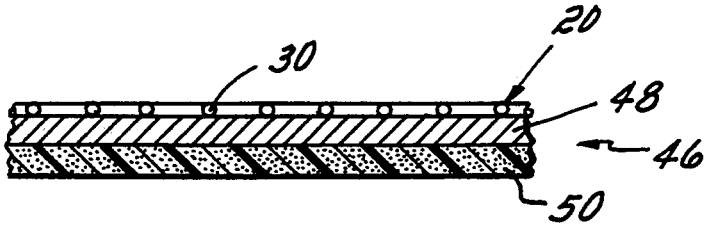
FIG. 7 is a cross sectional view of a portion of a still further embodiment of the insole of this invention.

The problem of bleed-through of materials such as polyurethane during the insole molding operation can also be solved by insoles 46 of the type illustrated in FIG. 7. In insole 46, a comparatively thick stabilizing layer 48 is interposed between the apertured top layer 20 and a cushioning layer 50 formed of polyurethane. Preferably, the stabilizing layer 48 is formed of a non-woven material which is thick enough to substantially prevent the passage of polyurethane or similar material therethrough in the course of the insole forming operation described above.

It is contemplated that the barrier layers 40 or 48 could be eliminated if the cushioning layer 44 is formed of materials such as crosslinked polyethylene or latex foam. See FIG. 6. These materials have the consistency similar to that of whipped cream when they are combined with the laminate of the apertured top layer 20 and stabilizing layer 22, and therefore present little or no problem of bleeding through the non-woven layer 22 and/or apertured top layer 20.

Figure 9:
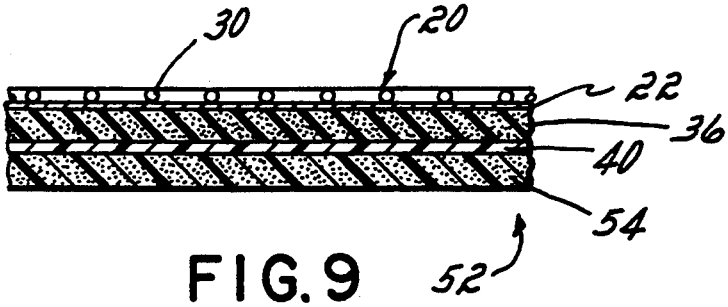
FIG. 9 is a cross sectional view of a portion of a still further embodiment of the insole of this invention.

A still further embodiment of an insole 52 is illustrated in FIG. 9 which essentially comprises the same layers included in the insole 34 depicted in FIG. 6, with the addition of a barrier layer 40 and a second cushioning layer 54. This insole 52 is preferably formed in the same general configuration as insole 34 depicted in FIGS. 1 and 3. In the presently preferred embodiment, the insole 52 includes the apertured top layer 20 and stabilizing layer 22 of the previous embodiments, a first cushioning layer 36 preferably formed of a material such as crosslinked polyethylene or a latex foam, a barrier layer 40 and the second cushioning layer 54 formed of polyurethane. The insole 52 exhibits exceptional resiliency and comfort, while maintaining good structural integrity.

In each of the embodiments of the insoles depicted in FIGS. 4–9, an important aspect of their construction is the frictional characteristics exhibited by the apertured top layer 20. As mentioned above, the apertured top layer 20 is preferably formed of a non-absorbent, thermally non-conductive thermoplastic material such as an ethylene-vinyl acetate copolymer whose vinyl acetate content can be varied to alter the coefficient of friction of such material. In the presently preferred embodiment, the vinyl acetate content of the apertured top layer 20 is maintained in the range of about 3% to 40% by weight, and is selected to provide a coefficient of friction such that the magnitude of the frictional engagement between the apertured top layer 20 and the sock 14 is maintained less than the magnitude of the frictional engagement between the sock 14 and foot 16. A principal objective of this invention is to induce movement of the foot 16 and sock 14 together as a unit along the apertured top layer 20 within the interior of the shoe 10, in response to the application of shear forces to the foot 16, instead of allowing the sock 14 to stick to the apertured top layer 20 so that the foot 16 can move relative to the sock 14. Movement of the foot 16 within the sock 14 should be avoided because it induces the formation of blisters and other damage to the foot 16. By controlling the frictional characteristics of the apertured top layer 20, the foot 16 and sock 14 move together relative to the apertured top layer 20 so that the sock 14 protects the foot 16.

Importantly, tests have shown that the coefficient of friction of the apertured top layer 20 of this invention remains substantially constant whether the apertured top layer 20 is wet or dry. This is true over the entire range of different coefficients of friction which can be provided by the apertured top layer 20 as the vinyl acetate content of the ethylene-vinyl acetate copolymer is varied. As a result, the magnitude of the frictional engagement between the apertured top layer 20 and sock 14 remains essentially the same when the foot sweats and the sock 14 becomes moist after the wearer begins an activity, whereas the magnitude of the frictional engagement between the sock 14 and foot 16 increases as the sock 14 becomes wet. Because the frictional engagement between the top layer 20 and sock 14 remains substantially constant, it is always maintained less than the frictional engagement between the sock 14 and foot 16. The foot 16 is therefore protected from sliding motion along the sock 14, and the incidence of blisters and other problems caused by rubbing of the foot 16 along the sock 14 are substantially eliminated.

While the overall objective of the insole of each of the embodiments of this invention is to substantially prevent movement of the foot 16 with respect to the sock 14, it is nevertheless desirable to vary the coefficient of friction of the apertured top layer 20 of insoles 18, 34, 38, 42, 46 and 52 and thus vary the magnitude of the frictional engagement between the apertured top layer 20 and sock 14. For example, activities such as basketball, racquetball, squash, aerobic exercises, and the like are typically played on surfaces such as lacquered hardwood floors which permit little or no movement of the outsole of the article of footwear with respect to such surfaces. The same is true of "Astroturf" or other forms of artificial playing surfaces. Because of the relatively high coefficient of friction of such surfaces, and the design of the outsole of the articles of footwear intended for use on such surfaces, relatively high shear forces are applied through the article of footwear to the foot and sock while playing activities on these surfaces. In order to avoid the application of undue shear forces to the foot, it is preferable to allow at least some sliding motion of the foot and sock, as a unit, with respect to the apertured top layer 20 of each of the insoles described above. This is accomplished by lowering the vinyl acetate content of the apertured top layer 20, e.g., on the order of about 3–6% by weight, for example, so that the coefficient of friction of the apertured top layer 20 is reduced to a level on the order of about 0.4. This permits some sliding motion of the foot and sock along the apertured top layer in response to the application of shear forces thereof. But such coefficient of friction also provides for a degree of slip resistance between the apertured top layer and sock so as to avoid unrestricted movement of the foot and sock within the article of footwear and therefore prevent violent contact of the foot with the toe or other areas of the shoe which can cause "turf toe" and other foot problems.

Many other types of activities do not result in the application of high shear forces to the foot, and considerations such as comfort, "feel" and control of the shoe are paramount. For example, activities such as the play of tennis on clay courts or soccer on grass results in the shoe readily sliding with respect to the playing surface. Running, walking, hiking and similar activities also do not result in the application of comparatively high shear forces to the foot. In order to accommodate these types of activities, the coefficient of friction of the apertured top layer 20 of any of the insoles herein is increased to a level on the order of about 0.45 to 0.50 by increasing the vinyl acetate content of the apertured top layer 20 to a level on the order of about 12% or higher. This, in turn, increases the magnitude of the frictional engagement between the insole and sock. Any of the insoles of this invention described above having a higher coefficient of friction permits comparatively lesser sliding movement of the sock therealong to provide an enhanced feeling of control of the article of footwear, but, nevertheless, the magnitude of the frictional engagement between the sock and insole is maintained less than that between the sock and foot.

While the invention has been described with reference to a preferred embodiment, it will be understood by those skilled in the art that various changes may be made and equivalents may be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An insole for an article of footwear, comprising:

a slip-resistant, non-absorbent and thermally non-conductive first layer formed with a plurality of apertures, said apertures forming wall sections in said first layer therebetween;

a stabilizing layer formed of non-woven fibrous material having a first surface affixed to said first layer and a second surface, said stabilizing layer being effective to substantially reduce movement of said wall sections of said first layer relative to one another in response to the application of a shear force to said first layer;

a barrier layer affixed to said second surface of said stabilizing layer, said barrier layer being formed of a substantially liquid impervious material selected from the group consisting of acrylic latex, polyethylene, vinyl and an ethylene-vinyl acetate copolymer, said barrier layer being adapted to overlie the sole of an article of footwear.

2. The insole of claim 1 in which said barrier layer includes an antimicrobial material having bacteriostatic and fungistatic properties.

3. An insole for an article of footwear, comprising:

a slip-resistant, non-absorbent and thermally non-conductive first layer formed with a plurality of apertures, said apertures forming wall sections in said first layer therebetween;

a stabilizing layer formed of non-woven fibrous material having a first surface affixed to said first layer and a second surface, said stabilizing layer being effective to substantially reduce movement of said wall sections of said first layer relative to one another in response to the application of a shear force to said first layer;

a barrier layer affixed to said second surface of said stabilizing layer, said barrier layer being formed of a substantially liquid impervious material selected from the group consisting of acrylic latex, polyethylene, vinyl and an ethylene-vinyl acetate copolymer;

a cushioning layer affixed to said barrier layer, said barrier layer being effective to substantially prevent bleed-through of said cushioning layer into said first layer, said cushioning layer being adapted to overlie the sole of an article of footwear.

4. The insole of claim 3 in which said barrier layer includes an antimicrobial material having bacteriostatic and fungistatic properties.

5. An insole for an article of footwear, comprising:

a slip-resistant, non-absorbent and thermally non-conductive first layer formed with a plurality of apertures, said apertures forming wall sections in said first layer therebetween;

a stabilizing layer formed of non-woven fibrous material having a first surface affixed to said first layer and a second surface, said stabilizing layer being effective to substantially reduce movement of said wall sections of said first layer relative to one another in response to the application of a shear force to said first layer;

a first cushioning layer having a first surface affixed to said second surface of said stabilizing layer, and a second surface;

a barrier layer having a first surface affixed to said second surface of said first cushioning layer, and a second surface;

a second cushioning layer affixed to said second surface of said barrier layer, said barrier layer being effective to substantially prevent bleed-through of said second cushioning layer, said second cushioning layer being adapted to overlie the sole of an article of footwear.

6. The insole of claim 5 in which said first layer is formed of an ethylene-vinyl acetate copolymer.

7. The insole of claim 6 in which said ethylene-vinyl acetate copolymer has a vinyl acetate content in the range of about 3% to 40% by weight.

8. The insole of claim 5 in which said first layer further includes a thermoplastic elastomer in an effective amount to increase the flexibility of said first layer.

9. The insole of claim 5 in which said first layer has in the range of about 7 to 107 apertures per square centimeter.

10. The insole of claim 5 in which said apertures are square in shape, said apertures forming spaced columns of first wall sections and spaced rows of second wall sections which intersect said first wall sections, said first layer having in the range of about 8 to 9 columns of first wall sections per lineal centimeter and in the range of about 8 to 9 rows of second wall sections per lineal centimeter.

11. The insole of claim 5 in which said wall sections of said first layer have a height dimension and a width dimension each in the range of about 0.38 to 3.8 millimeters.

12. The insole of claim 11 in which said non-woven fibrous material forming said stabilizing layer is selected from the group consisting of polyester, a blend of polyester and rayon, and a blend of cellulosic fibers and polyester.

13. The insole of claim 5 in which said first layer has a surface opposite said stabilizing layer which is adapted to contact the sock of a wearer of the article of footwear, said first layer having frictional characteristics such that the magnitude of the frictional engagement between said surface of said first layer and the sock is maintained less than the magnitude of the frictional engagement between the sock and foot of the wearer whether said first layer is wet or dry, whereby the foot and sock are movable as a unit with respect to said surface of said first layer while the foot is maintained substantially fixed within the sock.

14. The insole of claim 5 in which said barrier layer is formed of substantially liquid impervious material.

15. The insole of claim 14 in which said substantially liquid impervious material forming said barrier layer is selected from the group consisting of acrylic latex, polyethylene, vinyl and an ethylene-vinyl acetate copolymer.

16. The insole of claim 5 in which said barrier layer includes an antimicrobial material having bacteriostatic and fungistatic properties.

17. The insole of claim 5 in which said first cushioning layer is formed of a material selected from the group consisting of latex foam and crosslinked polyethylene foam.

18. The insole of claim 5 in which said second cushioning layer is formed of a polyurethane foam.

* * * * *